US007384716B2

(12) United States Patent
Kinomoto

(10) Patent No.: US 7,384,716 B2
(45) Date of Patent: Jun. 10, 2008

(54) COATING COMPOSITION FOR ELECTROPHOTOGRAPHIC PHOTORECEPTOR, METHOD FOR PRODUCING ELECTROPHOTOGRAPHIC PHOTORECEPTOR, ELECTROPHOTOGRAPHIC PHOTORECEPTOR, AND IMAGE-FORMING APPARATUS

(75) Inventor: Masanori Kinomoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 421 days.

(21) Appl. No.: 11/070,743

(22) Filed: Mar. 2, 2005

(65) Prior Publication Data

US 2005/0196690 A1 Sep. 8, 2005

(30) Foreign Application Priority Data

Mar. 3, 2004 (JP) ..... 2004-059539

(51) Int. Cl.
*G03G 15/02* (2006.01)

(52) U.S. Cl. ..... 430/59.4; 430/59.1; 252/500; 252/501.1

(58) Field of Classification Search ..... 430/56, 430/59.1, 59.4, 78, 133; 252/501.1, 500
See application file for complete search history.

(56) References Cited

U.S. PATENT DOCUMENTS

| | | | | |
|---|---|---|---|---|
| 6,025,102 | A * | 2/2000 | Pai et al. | 430/58.8 |
| 6,156,468 | A * | 12/2000 | Wehelie et al. | 430/65 |
| 2002/0051921 | A1* | 5/2002 | Morita et al. | 430/78 |
| 2003/0118927 | A1 | 6/2003 | Nakamura et al. | |

FOREIGN PATENT DOCUMENTS

| | | |
|---|---|---|
| CN | 1412624 | 4/2003 |
| JP | 02-272567 | 7/1990 |
| JP | 05-127395 | 5/1993 |
| JP | 06-130681 | 5/1994 |
| JP | 07-013364 | 1/1995 |
| JP | 2644582 | 8/1997 |
| JP | 11-019554 | 1/1999 |
| JP | 11-343438 | 12/1999 |
| JP | 2000-075511 | 3/2000 |
| JP | 2002-370065 | 12/2002 |
| JP | 2003-029433 | 1/2003 |
| JP | 2004-029134 | 1/2004 |

OTHER PUBLICATIONS

CRC Handbook of Chemistry and Physics, 87th Edition, 2006-2007.* http://www.hydramotion.com/Units_of_viscosity.html (Jun. 4, 2007).*

* cited by examiner

*Primary Examiner*—Mark F. Huff
*Assistant Examiner*—Peter L. Vajda
(74) *Attorney, Agent, or Firm*—Renner, Otto, Boisselle & Sklar, LLP

(57) ABSTRACT

A coating composition for an electrophotographic photoreceptor that forms a charge-generating layer by being ejected from ejection nozzles in a form of droplets, comprises a charge-generating substance, a binding resin, and a solvent, has a viscosity of 1 mPa·s to 10 mPa·s, and the solvent contains at least one kind of high-boiling point solvent having a boiling point of 120° C. to 260° C., and the high-boiling point solvent is contained at a ratio of 5 parts by weight to 40 parts by weight with respect to 100 parts by weight of the coating composition for an electrophotographic photoreceptor.

7 Claims, 2 Drawing Sheets

COATING COMPOSITION FOR ELECTROPHOTOGRAPHIC PHOTORECEPTOR, METHOD FOR PRODUCING ELECTROPHOTOGRAPHIC PHOTORECEPTOR, ELECTROPHOTOGRAPHIC PHOTORECEPTOR, AND IMAGE-FORMING APPARATUS

BACKGROUND OF THE INVENTION

1. Field of the Invention

The present invention relates to a coating composition for an electrophotographic photoreceptor that is applied to form a charge-generating layer constituting an electrophotographic photoreceptor, an electrophotographic photoreceptor produced by using the coating composition, a method for producing the electrophotographic photoreceptor, and an image-forming apparatus using the electrophotographic photoreceptor.

2. Description of the Related Art

Conventionally, for electrophotographic photoreceptors used in electrophotographic apparatuses to which Carlson process is applied, inorganic photoconductive materials such as a selenium alloy, zinc oxide, and cadmium sulfide have been used. Inorganic photoconductive materials have disadvantages such as being harmful for the human body, having poor formability, being heavy, and being expensive. In recent years, there has been active development of electrophotographic photoreceptors using organic photoconductive materials that are superior to inorganic photoconductive materials in terms of, for example, non-toxicity, formability, light weight, and low price.

For example, a bisazo compound is an organic photoconductive material. A bisazo compound generally has a good sensitivity to light in the short-wavelength region or the middle-wavelength region, but the sensitivity to light in the long-wavelength region is low. Therefore, a bisazo compound is difficult to put into practical use when a semiconductor laser is used as a light source. As organic photoconductive materials having a relatively good sensitivity to light in the long-wavelength region, for example, a squaric acid methine dye, an indoline dye, a cyanine dye, and a pyrylium dye are known. However, these materials do not have a sufficient stability in repeated use and are difficult to put into practical use. As organic photoconductive materials having a good sensitivity to light in the long-wavelength region and a relatively good stability in repeated use, a phthalocyanine compound is known and has been actively researched as an organic photoconductive material in recent years.

As organic electrophotographic photoreceptors using an organic photoconductive material, electrophotographic photoreceptors of a so-called function-separated and layered type are known in which its photosensitive layer is divided into a charge-generating layer for generating charged carriers by receiving light and a charge-transporting layer for transporting the generated charged carriers. In these organic electrophotographic photoreceptors of the function-separated and layered type, each of the layers is formed of an optimal material for exerting its function, and these layers are combined, so that the sensitivity can be improved significantly and the sensitivity to the wavelength of light for exposure can be accordingly enhanced. Because of these advantages, electrophotographic photoreceptors of the function-separated and layered type have come to the mainstream of development, are being put into practical use, and are used in electrophotographic apparatuses such as copiers, printers, and facsimiles. In particular, electrophotographic photoreceptors formed by using oxotitanylphthalocyanine, which is a photoconductive material, as a charge-generating substance are often used in digital image-forming apparatuses because of their high sensitivity to light in the long-wavelength region, but there is the problem that the cost is relatively high.

An organic electrophotographic photoreceptor of the function-separated and layered type has a photosensitive layer including a charge-generating layer and a charge-transporting layer. The photosensitive layer is produced as follows; a coating composition for an electrophotographic photoreceptor in which an organic charge-generating substance and a binding resin are dispersed or dissolved in an organic solvent is applied onto a hollow cylindrical conductive substrate and dried to form a charge-generating layer; then a coating composition for an electrophotographic photoreceptor in which a charge-transporting substance and a binding resin are dispersed or dissolved in an organic solvent is applied thereon and dried to form a charge-transporting layer.

A photosensitive layer is required to be a thin film and to have a uniform film thickness. More specifically, higher performance of an electrophotographic photoreceptor can be realized by applying a thinner photosensitive layer with a uniform thickness. Therefore, new application methods have been under development and examination in order to allow application at lower cost.

As methods for forming a photosensitive layer by applying a coating composition for an electrophotographic photoreceptor onto a conductive substrate serving as a bare tube for a photoreceptor, for example, dip coating, roll coating, blade coating, and spray coating are conventionally known. However, these methods have problems such as inability of providing uniform coating films or poor production efficiency.

The dip coating method is often used in manufacturing an electrophotographic photoreceptor, in which method a conductive substrate serving as a bare tube for a photoreceptor is dipped while one end thereof being held and the surface subjected to application of the coating composition for an electrophotographic photoreceptor being held perpendicular to the liquid surface of the coating composition for an electrophotographic photoreceptor, and then lifted from the coating composition However, the film thickness of the layer that is obtained by the dip coating method depends significantly on the lifting speed at which the conductive substrate is lifted from the coating composition, the viscosity of the coating composition, and the evaporation speed of a volatile component contained in the coating composition. Therefore, these factors have to be controlled strictly. Furthermore, since the conductive substrate is lifted from the coating composition in the vertical direction, the coating composition flows down along the surface of the conductive support by gravity effect, and the film thickness of the conductive support on the lower side in the lifting direction is larger than that on the upper side. Thus, a difference in the sensitivity appears in the vertical direction. A coating composition for an electrophotographic photoreceptor applied onto a lower portion is difficult to dry, and when a next coating composition for an electrophotographic photoreceptor is applied before the previous one has been dried completely, these coating compositions for an electrophotographic photoreceptor are mixed, and thus a desired photosensitive layer may not be formed. Furthermore, a coating composition for an electrophotographic photoreceptor flows into an end portion that is to be a non-printed portion, and thus masking and a process of eliminating the coating composition for an electrophotographic photoreceptor are necessary. In addition, in order to dip a conductive substrate, a coating composition for an electrophotographic photoreceptor in at least an amount that is sufficient for dipping the conductive substrate is necessary, and there is no choice but to dispose of the coating composition for an electrophotographic photoreceptor after a period during which the coating composition for an electrophotographic photoreceptor can be used (pot life), and thus the use efficiency of the coating composition for an electrophotographic photoreceptor is poor.

In roll coating, a film of a coating composition for an electrophotographic photoreceptor with a regulated film thickness is formed on a coating roll, and while a conductive substrate located near or in contact with the coating roll and the coating roll are rotated, the coating composition for an electrophotographic photoreceptor is transferred and applied from the coating roll onto the conductive substrate. However, when detaching the coating roll and the conductive substrate after the application, a so-called liquid trailing phenomenon, that is, a phenomenon in which an extra coating composition for an electrophotographic photoreceptor is attached to the conductive substrate by the surface tension of the coating composition for an electrophotographic photoreceptor tends to occur, and a joint remains in the coating film because of this liquid trailing phenomenon, and the film thickness becomes non-uniform. As a result, defects occur in the images.

In the blade coating method, a blade is located near a conductive substrate, a coating composition for an electrophotographic photoreceptor is supplied to the blade, the coating composition for an electrophotographic photoreceptor is applied onto the conductive substrate with the blade, and the blade is withdrawn after one rotation of the conductive substrate. The method provides high productivity, but when the blade is withdrawn, a part of the coating film applied to the conductive substrate is protruded by surface tension of the coating composition and the film thickness becomes non-uniform.

In the spraying coating method, coating is performed by spraying a coating composition for an electrophotographic photoreceptor from a spray nozzle in the form of fine particles, and therefore the appearance after coating is good. However, since a thickness of a layer formed by one coating is small, it is necessary to repeat coating a plurality of times in order to obtain a desired thickness. Furthermore, when a large amount of coating composition for an electrophotographic photoreceptor is applied for coating, the coating composition for an electrophotographic photoreceptor is dropped, and a coating layer with non-uniform thickness is formed. Furthermore, a coating composition for an electrophotographic photoreceptor is ejected from spray nozzles in the form of a cone, and therefore the precision of application is poor and masking is necessary in order to prevent, for example, the coating compositions for an electrophotographic photoreceptor from flowing into an end portion of a conductive substrate. In addition, the application efficiency is poor, so that an apparatus for collecting a coating composition for an electrophotographic photoreceptor that is not applied is necessary, and a processing apparatus is newly necessary in order to reuse the collected coating composition for an electrophotographic photoreceptor. Thus, processes other than application increase, and the production efficiency becomes poor.

As another method than the above, a method in which a coating composition for an electrophotographic photoreceptor is applied by ink-jet coating is used. In the method in which a coating composition for an electrophotographic photoreceptor is applied by ink-jet coating, while relatively moving an object to be coated and ejection nozzles, a coating composition for an electrophotographic photoreceptor is ejected from the minute ejection nozzles in the form of droplets and is attached to the object to be coated. Examples of systems for ejecting a coating composition for an electrophotographic photoreceptor from the ejection nozzles include piezoelectric ejection in which a coating composition for an electrophotographic photoreceptor is pressed out and ejected by a vibration of piezoelectric elements (piezo elements), Bubble Jet (registered trademark) in which voltage is applied to a heater, bubbles are generated in a coating composition for an electrophotographic photoreceptor, so that the coating composition for an electrophotographic photoreceptor is ejected, and thermal ink-jet ejection in which voltage is applied to a heater, bubbles are generated in a coating composition for an electrophotographic photoreceptor, the bubbles are collapsed, so that the coating composition for an electrophotographic photoreceptor is ejected.

A typical conventional technique is described in JP H11-19554A. In a method for applying a coating solution (a coating composition for an electrophotographic photoreceptor) disclosed in JP H11-19554A, a coating solution is applied by ink-jet coating.

As another conventional technique, a technique similar to that in JP H11-19554A is described in Japanese Patent No. 2644582. In a method for producing an electrophotographic photoreceptor disclosed in Japanese Patent No. 2644582, coating is performed by applying a pressure to let a coating material for forming an electrophotographic photoreceptor fly in the form of stripes from a plurality of minute openings continuously.

In ink-jet coating, a coating composition for an electrophotographic photoreceptor is ejected in the form of droplets from the minute ejection nozzles each having a size of several tens μm to form a charge-generating layer. Therefore, it is important to perform ejection in a stable manner without causing clogging due to dryness or aggregation of a pigment. Generally, in a coating composition for an electrophotographic photoreceptor having a high viscosity, sedimentation of a pigment tends not to occur and the uniformity can be ensured easily, but ejection performance becomes poor. In a coating composition for an electrophotographic photoreceptor having a low viscosity, ejection performance can be ensured easily, but sedimentation and aggregation of a pigment tend to occur, which may cause clogging of the nozzles.

In the method for applying a coating solution disclosed in JP H11-19554A, the method uses ink-jet coating, and thus ejected droplets can fly in the form of lines with an extremely high precision, and each of nozzles can be controlled, so that masking is not necessary and the application efficiency is extremely high. Furthermore, the coating solution can be replaced easily only by replacing a tank for storing the coating solution, and the coating composition for an electrophotographic photoreceptor can be used up, so that the production efficiency is extremely high. However, in the coating solution, tetrahydrofuran is used as a solvent. The boiling point of tetrahydrofuran is so low that the solvent volatilizes soon and thus the coating solution is dried in the ejection nozzles, and thus the nozzles are clogged. Furthermore, the uniformity of the film thickness after application (leveling performance) is not sufficient.

In the method for producing an electrophotographic photoreceptor disclosed in Japanese Patent No. 2644582, a pressure is applied to let a coating material for forming an electrophotographic photoreceptor be applied from a plurality of minute openings, and thus the application can be performed onto a large area unlike the application method using ink-jet coating. However, in this method, each of the minute openings cannot be controlled one by one, and there is a time lag between pressure application and ejection since the pump for applying a pressure and the minute openings are connected by a tube, so that both of the precision and the response become poor.

SUMMARY OF THE INVENTION

An object of the invention is to provide a coating composition for an electrophotographic photoreceptor that does not clog the ejection nozzles due to, for example, dryness and aggregation, that can be ejected in a stable manner and that can be applied onto a conductive substrate with a uniform thickness in a method in which a coating composition for an electrophotographic photoreceptor is ejected and applied from the ejection nozzles, an electrophotographic photoreceptor produced by using the coating composition, a method for producing the electrophotographic photoreceptor, and an image-forming apparatus using the electrophotographic photoreceptor.

The invention provides a coating composition for an electrophotographic photoreceptor that forms a charge-generating layer by being ejected from ejection nozzles in a form of droplets, the coating composition comprising:

a charge-generating substance, a binding resin, and a solvent, a viscosity of the coating composition being in a range of 1 mPa·s to 10 mPa·s, wherein the solvent contains one or at least two high-boiling point solvents having a boiling point of 120° C. to 260° C., and wherein the one or at least two high-boiling point solvents are contained at a ratio of 5 parts by weight to 40 parts by weight with respect to 100 parts by weight of the coating composition for an electrophotographic photoreceptor.

Furthermore, in the invention, it is preferable that boiling points of the one or at least two high-boiling point solvents are in a range of 150° C. to 260° C.

Furthermore, in the invention, it is preferable that the coating composition for an electrophotographic photoreceptor comprises two high-boiling point solvents, and a difference between their boiling points is in a range of 70° C. to 110° C.

Furthermore, in the invention, it is preferable that a difference between their boiling points is in a range of 80° C. to 110° C.

Furthermore, in the invention, it is preferable that the one or at least two high-boiling point solvents are any selected from the group consisting of cyclohexanone, pyrrolidone, n-methylpyrrolidone, and p-xylene.

Furthermore, in the invention, it is preferable that the solvent contains a low-boiling point solvent having a boiling point of at least 30° C. and less than 120° C.

Furthermore, in the invention, it is preferable that a difference in a boiling point between the low-boiling point solvent and the one or at least two high-boiling point solvents is 70° C. or more.

Furthermore, in the invention, it is preferable that a content of the low-boiling point solvent is at least 1.4 times and at most 10 times a content of the high-boiling point solvent.

Furthermore, in the invention, it is preferable that the charge-generating substance is a phthalocyanine compound.

Furthermore, the invention provides a method for producing an electrophotographic photoreceptor, comprising:

an undercoat layer forming step of forming an undercoat layer on a conductive substrate, a charge-generating layer forming step of forming a charge-generating layer on the undercoat layer, and a charge-transporting layer forming step of forming a charge-transporting layer on the charge-generating layer, wherein at the charge-generating layer forming step, a charge-generating layer is formed by ejecting means for ejecting the coating composition for an electrophotographic photoreceptor from ejection nozzles in a form of droplets.

Furthermore, in the invention, it is preferable that in the ejecting means lets the coating composition for an electrophotographic photoreceptor be ejected from the ejection nozzles in the form of droplets, while relatively moving the undercoat layer and the ejection nozzles.

Furthermore, in the invention, it is preferable that the ejection nozzles eject the coating composition for an electrophotographic photoreceptor by a vibration of a piezoelectric element.

Furthermore, in the invention, it is preferable that at the undercoat layer forming step, the undercoat layer is formed on the conductive substrate by an dip coating method.

Furthermore, in the invention, it is preferable that at the charge-transporting layer forming step, the charge-transporting layer is formed on the charge-generating layer by an dip coating method.

Furthermore, the invention provides an electrophotographic photoreceptor produced by the method for producing an electrophotographic photoreceptor mentioned above.

Furthermore, the invention provides an image-forming apparatus using the electrophotographic photoreceptor mentioned above.

According to the invention, a coating composition for an electrophotographic photoreceptor is ejected from ejection nozzles in a form of droplets to form a charge-generating layer, the coating composition comprising a charge-generating substance and a solvent, a viscosity of the coating composition being in a range of 1 mPa·s to 10 mPa·s. Accordingly, the coating composition can be ejected from the ejection nozzles in a stable manner, so that a charge-generating layer having a uniform film thickness can be formed. Furthermore, the solvent contains one or at least two high-boiling point solvents having a boiling point of 120° C. to 260° C., preferably of 150° C. to 260° C., and the one or at least two high-boiling point solvents are contained at a ratio of 5 parts by weight to 40 parts by weight with respect to 100 parts by weight of the coating composition for an electrophotographic photoreceptor.

Thus, dryness or aggregation due to volatilization of the solvent in the coating composition for an electrophotographic photoreceptor does not tend to occur, and thus clogging of the ejection nozzles does not tend to be caused. Furthermore, a solvent having a high boiling point can enhance an effect of making the film thickness uniform (leveling performance), and thus a charge-generating layer having a uniform film thickness can be formed. Therefore, it is possible to provide a coating composition for an electrophotograpic photoreceptor that does not clog the ejection nozzles due to, for example, dryness and aggregation, that can be ejected in a stable manner and that can be applied onto a conductive substrate with a uniform thickness.

Furthermore, according to the invention, the solvent contains two high-boiling solvents having a significant difference in boiling point from each other such as 70° C. to 110° C., preferably of 80° C. to 110° C. Thus, it is possible to prevent more effectively the coating composition for an electrophotographic photoreceptor from being dried, so that the leveling performance after application can be improved more.

Furthermore, according to the invention, the high-boiling point solvents are any selected from the group consisting of cyclohexanone, pyrrolidone, n-methylpyrrolidone, and p-xylene. Thus, the coating composition has an appropriate boiling point and high leveling performance, so that the coating composition can be ejected in a more stable manner, and thus a charge-generating layer having a more uniform film thickness can be formed.

Furthermore, according to the invention, the solvent contains more than one kind of low-boiling point solvent having a boiling point of at least 30° C. and less than 120° C. Thus the coating composition is easily dried in an appropriate manner after application, so that a charge-generating layer having a uniform film thickness can be formed efficiently.

Furthermore, according to the invention, the low-boiling point solvent has a boiling point that is lower than the high-boiling point solvent by 70° C. or more. Thus, it is possible to achieve a balance between prevention of dryness of the coating composition for an electrophotographic photoreceptor during ejection, and dryness of the coating composition for an electrophotographic photoreceptor after application.

Furthermore, according to the invention, the content of the low-boiling point solvent is at least 1.4 times and at most 10 times the content of the high-boiling point solvent. Thus, it is possible to achieve a better balance between prevention of dryness of the coating composition for an electrophotographic photoreceptor during ejection, and dryness of the coating composition for an electrophotographic photoreceptor after application.

Furthermore, according to the invention, the charge-generating substance is a phthalocyanine compound. Thus, a charge-generating layer having a good sensitivity to light in a longer wavelength region can be formed.

Furthermore, according to the invention, an undercoat layer is formed on a conductive substrate at the undercoat layer forming step. A charge-generating layer is formed on the undercoat layer at the charge-generating layer forming step by ejecting means for ejecting the coating composition for an electrophotographic photoreceptor from ejection nozzles in a form of droplets. A charge-transporting layer is formed on the charge-generating layer at the charge-transporting layer forming step. Thus, it is possible to form an electrophotographic photoreceptor having the undercoat layer, the charge-generating layer, and the charge-transporting layer, in which the charge-generating layer has a uniform film thickness.

Furthermore, according to the invention, while relatively moving the undercoat layer and the ejection nozzles, the ejecting means for ejecting the coating composition for an electrophotographic photoreceptor from the ejection nozzles in the form of droplets is used. Thus, an electrophotographic photoreceptor having a more uniform charge-generating layer can be produced.

Furthermore, according to the invention, the ejection nozzles that eject the coating composition for an electrophotographic photoreceptor by a vibration of a piezoelectric element is used. Thus, ejection instabilities caused by kogation do not occur, so that ejection can be performed in a stable manner and an electrophotographic photoreceptor having a more uniform charge-generating layer can be produced.

"Kogation" refers to a phenomenon in which, in thermal ink-jet ejection that ejects a coating composition for an electrophotographic photoreceptor from nozzles by a pressure of bubbles generated by heating a heater, for example, a substance obtained by thermally degrading resin or the like in the coating composition for an electrophotographic photoreceptor, or a very small amount of impurities or aggregate is adhered and deposited onto the heater, so that heating by the heater becomes insufficient, and ejection cannot be performed in a stable manner.

Furthermore, according to the invention, an undercoat layer is formed on a conductive substrate by the dip coating method. Thus, an electrophotographic photoreceptor having an undercoat layer with an appropriate film thickness can be produced.

Furthermore, according to the invention, a charge-transporting layer is formed on the charge-generating layer by the dip coating method. Thus, an electrophotographic photoreceptor having a charge-transporting layer with an appropriate film thickness can be produced.

Furthermore, the invention is an electrophotographic photoreceptor produced by the method for producing an electrophotographic photoreceptor. Thus, the electrophotographic photoreceptor has an undercoat layer, a charge-generating layer, and a charge-transporting layer, in which the film thickness of each layer is appropriate, and the film thickness of the charge-generating layer is uniform.

Furthermore, the invention is an image-forming apparatus using the electrophotographic photoreceptor. Thus images having excellent image quality without bleeding or fog can be obtained.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
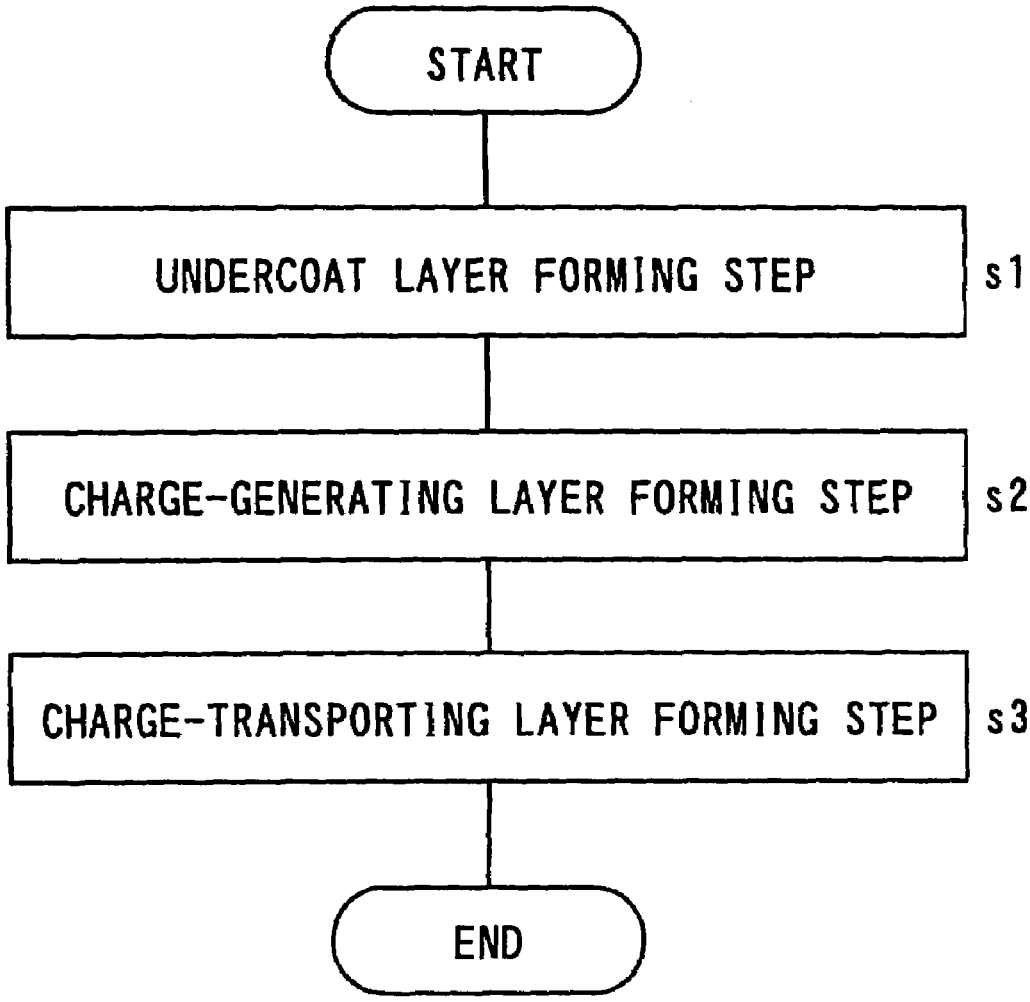
FIG. 1 is a flow chart showing a method for producing an electrophotographic photoreceptor, which is one embodiment of the invention.

Now referring to the drawings, preferred embodiments of the invention are described below.

Coating Composition for an Electrophotographic Photoreceptor

As one embodiment of the invention, a coating composition for an electrophotographic photoreceptor for a charge-generating layer will be described.

The coating composition for an electrophotographic photoreceptor for a charge-generating layer contains, for example, a charge-generating substance, a binding resin, and a solvent, and can form a charge-generating layer by being ejected from ejection nozzles in the form of droplets. The charge-generating substance and the binding resin are raw materials for forming the charge-generating layer that need to allow the charge-generating layer to exert the function thereof. Furthermore, the ejection performance, the volatility, and the leveling performance after application of the coating composition for an electrophotographic photoreceptor are adjusted with the solvent.

Charge-Generating Substance

A charge-generating substance is contained in the coating composition for an electrophotographic photoreceptor, which is an embodiment of the invention. For the charge-generating substance, it is possible to use any known substance as long as the substance generates charges by absorbing visible light, and, for example, inorganic pigments, organic pigments, and organic dyes can be used. Examples of inorganic pigments include selenium, selenium alloys, arsenic-selenium, cadmium sulfide, zinc oxide, and amorphous silicone. Examples of organic pigments include phthalocyanine compound, azo compound, quinacridone compound, polycyclic quinone compound, and perylene compound. Examples of organic dyes include thiopyrylium salt and squarylium salt. Among these, phthalocyanine compounds are used preferably, and oxotitanylphthalocyanine compounds are used more preferably.

Among the above-mentioned substances, inorganic pigments such as selenium, a selenium alloy, arsenic-selenium, cadmium sulfide, zinc oxide, and amorphous silicone have a high specific gravity and tend to have a high settleability, so that sedimentation and aggregation tend to occur at a nozzle portion, which results in ejection instabilities with high probability. Furthermore, inorganic pigments are so solid that nozzles are worn away soon, and thus the durability deteriorates. Therefore, it is preferable to use an organic pigment as a charge-generating substance.

Binding Resin

A binding resin is contained in the coating composition for an electrophotographic photoreceptor, which is an embodiment of the invention. For the binding resin, known substances, for example, polyalylate, polyvinyl butyral, polycarbonate, polyester, polystyrene, polyvinyl chloride, phenoxy resin, epoxy resin, silicone, and polyacrylate can be used.

Solvent

A solvent is contained in the coating composition for an electrophotographic photoreceptor, which is an embodiment of the invention. As the solvent, a high-boiling point solvent and a low-boiling point solvent are contained. The volatility of the coating composition for an electrophotographic photoreceptor can be adjusted by containing a high-boiling point solvent and a low-boiling point solvent. Furthermore, the leveling performance after application can be improved by containing a high-boiling point solvent.

The boiling point of the high-boiling point solvent is preferably in a range of 120° C. to 260° C., more preferably in a range of 150° C. to 260° C. For the high-boiling point solvent, known solvents, for example, cyclohexanone, pyrrolidone, n-methylpyrrolidone, and p-xylene can be used preferably, and cyclohexanone, pyrrolidone, and n-methylpyrrolidone can be used more preferably. Furthermore, two or more kinds of high-boiling point solvents may be contained in combination. In this case, a difference in the boiling point between a high-boiling point solvent having a higher boiling point and a high-boiling point solvent having a lower boiling point is preferably 70° C. to 110° C., more preferably 80° C. to 110° C. For the high-boiling point solvent having a higher boiling point, for example, pyrrolidone can be used. For the high-boiling point solvent having a lower boiling point, for example, cyclohexanone and p-xylene can be used. The content of the high-boiling point solvent according to the invention is in a range of 5 parts by weight to 40 parts by weight with respect to 100 parts by weight of the coating composition for an electrophotographic photoreceptor. When the content is smaller than 5 parts by weight, the ejection performance from the ejection nozzles and the leveling performance after application deteriorate. When the content is larger than 40 parts by weight, the coating composition for an electrophotographic photoreceptor is so difficult to dry that the coating composition drops after application, and thus a uniform film thickness of the charge-generating layer cannot be obtained.

The boiling point of the low-boiling point solvent is preferably at least 30° C. and less than 120° C. A difference in the boiling point between the low-boiling point solvent and the high-boiling point solvent is preferably 70° C. or more, more preferably 80° C. or more. For the low-boiling point solvent, known solvents, for example, isopropyl alcohol, toluene, acetone, ethyl methyl ketone, ethylcellosolve, ethyl acetate, methyl acetate, dichloromethane, dichloroethane, chlorobenzene, ethylene glycol dimethyl ether can be used. It is preferable that the low-boiling point solvent is contained in a weight of at least 1.4 times and at most 10 times the weight of the high-boiling point solvent.

Additive

Additives such as a chemical sensitizer, an optical sensitizer, a plasticizer, a leveling agent, an antioxidant, and an ultraviolet absorbent may be contained in the coating composition for an electrophotographic photoreceptor, which is an embodiment of the invention.

A chemical sensitizer or an optical sensitizer may be contained in order to improve the sensitivity and to prevent an increase of residual potential and a fatigue of layers after repeated use. For the chemical sensitizer, known electron-accepting materials, for example, acid anhydrides such as succinic anhydride, maleic anhydride, phthalic anhydride and 4-chlornaphthalic anhydride, cyano compounds such as tetracyanoethylene, terephthalmalondinitrile and 7,7,8,8-tetracyanoquinodimethane, aldehydes such as 4-nitrobenzaldehyde, quinones such as anthraquinone, 1-nitroanthraquinone and p-benzoquinone, and polycyclic or heterocycle nitro compounds such as 2,4,7-trinitrofluorenone and 2,4,5,7-tetranitrofluorenone can be used. For the optical sensitizer, known dyes, for example, xanthene dye, thiazine dye, triphenylmethane dye, quinoline pigment, and copper phthalocyanine can be used.

A plasticizer may be contained in order to improve the formability, the flexibility, and the mechanical strength of a formed layer. For the plasticizer, known substances, for example, dibasic acid ester, fatty acid ester, phosphate ester, phthalic acid ester, chlorinated paraffin, and epoxy plasticizer can be used.

A leveling agent may be contained in order to prevent orange peeling of a formed layer. For the leveling agent, known substances, for example, polysiloxane can be used.

An antioxidant and an ultraviolet absorbent may be contained in order to improve the durability of a formed layer. For the antioxidant, known substances, for example, phenolic compound, hydroquinon compound, tocopherol compound, and amine compound can be used. For the ultraviolet absorbent, known substances can be used.

Preparation Method

The charge-generating substance, the binding resin, the additives etc. are added to the solvent and dispersed by using a disperser, and thus a coating composition for an electrophotographic photoreceptor is prepared. For the disperser, known apparatuses, for example, a ball mill, a sand grinder, a paint shaker, and an ultrasonic disperser can be used.

It is preferable that the viscosity of the coating composition for an electrophotographic photoreceptor is in a range of 1 mPa·s to 10 mPa·s. In order to prepare a coating composition having a viscosity of lower than 1 mPa·s, it is necessary to reduce the solid content significantly. Therefore, recoating is necessary, which is not preferable in light of the application efficiency. When the viscosity is higher than 10 mPa·s, it is difficult to eject the coating composition from the ejection nozzles.

Method for Producing Electrophotographic Photoreceptor

As one embodiment of the invention, a method for producing an electrophotographic photoreceptor will be described.

FIG. 1 is a flow chart showing a method for producing an electrophotographic photoreceptor, which is one embodiment of the invention. The method for producing an electrophotographic photoreceptor includes step s1 of forming an undercoat layer, step s2 of forming a charge-generating layer, and step s3 of forming a charge-transporting layer. In the step of forming a charge-generating layer, a charge-generating layer is formed by using the above-described coating composition for an electrophotographic photoreceptor.

Step of Forming an Undercoat Layer

First, an oxide, a binding resin, a solvent, etc. are dispersed by using a disperser, and thus a coating composition for an electrophotographic photoreceptor for an undercoat layer is prepared.

For the oxide, known oxides, for example, titanium oxide, stannic oxide, and aluminum oxide can be used. For the binding resin, known resins, for example, polyamide, polyurethane, cellulose, cellulose nitrate, polyvinyl alcohol, polyvinyl pyrrolidone, polyacrylamide, gelatin, starch, casein, and N-methoxymethylated nylon can be used. For the solvent, known solvents, for example, methyl alcohol and 1,2-dichloroethane can be used. For the disperser, known dispersers, for example, a paint shaker can be used.

Next, at step s1 of forming an undercoat layer, the coating composition for an electrophotographic photoreceptor that has been prepared is applied onto a bare tube for a photoreceptor serving as a conductive substrate by the dip coating method, and thus an undercoat layer is formed.

The conductive substrate serves as an electrode on the photoreceptor, and also as a supporting member for other layers. The form thereof can be any of a cylinder, a plate, a film, and a belt. For the material thereof, it is possible to use any material as long as the substance is conductive, and for example, metal materials such as aluminum, stainless steel, copper, and nickel, and insulating materials such as a polyester film, a phenol resin pipe, and a paper tube whose surface is provided with a conductive layer made of, aluminum, copper, palladium, stannic oxide, indium oxide etc. It is preferable that the material has such a conductivity that the volume resistivity is $10^{10}$ Ω·cm or less. An oxidation treatment may be performed on the surface thereof in order to adjust the volume resistivity.

Step of Forming a Charge-Generating Layer

Figure 2:
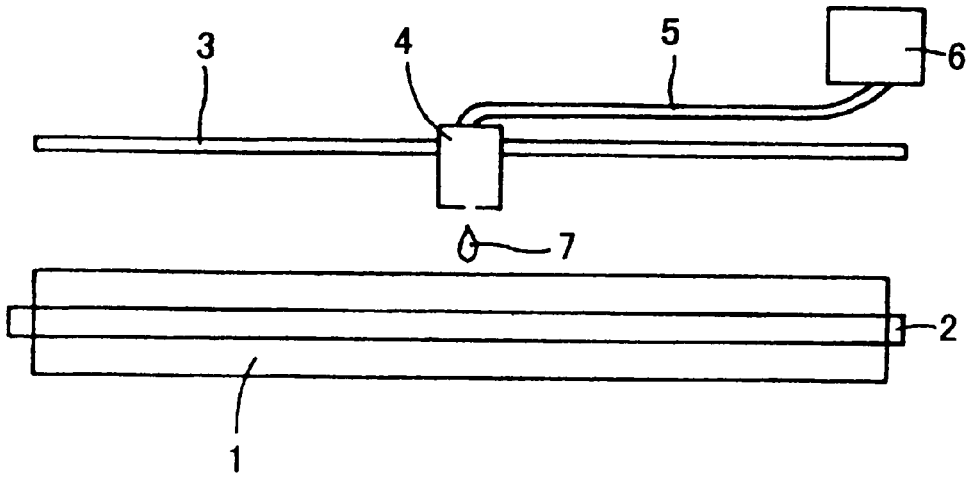
FIG. 2 is a schematic view showing an ink-jet application apparatus used in the invention.

Following step s1 of forming an undercoat layer, at step s2 of forming a charge-generating layer, the above-described coating composition for an electrophotographic photoreceptor for a charge-generating layer is ejected and applied from the ejection nozzles to the bare tube for a photoreceptor on which the undercoat layer is formed, and dried and solidified, and thus a charge-generating layer is formed. Examples of methods for ejecting a coating composition for an electrophotographic photoreceptor from the ejection nozzles to the bare tube for a photoreceptor on which the undercoat layer is formed include an application method using ink-jet coating. FIG. 2 is a schematic view showing an ink-jet application apparatus used in the invention. In the application method using ink-jet coating, droplets of the coating composition for an electrophotographic photoreceptor are ejected by using ejecting means, that is, the ink-jet application apparatus shown in FIG. 2. A conductive substrate 1 is held horizontally by a rotation shaft 2, and can rotate at a predetermined speed. An ejection portion 4 can move in parallel with the rotation shaft 2 by a guide rail 3 while being spaced apart from the conductive substrate 1 at a predetermined distance. The coating composition for an electrophotographic photoreceptor is supplied from a storage drum 6 via a conveyance path 5. The ejection portion 4 is provided with a piezoelectric element. When voltage is applied to the piezoelectric element, the internal volume of the ejection portion 4 is changed by the expansion and the contraction of the piezoelectric element, so that a droplet 7 of a coating composition for an electrophotographic photoreceptor can be ejected.

Step of Forming a Charge-Transporting Layer

First, a charge-transporting substance, a binding resin, a solvent, etc. are dispersed by using a disperser, and thus a coating composition for an electrophotographic photoreceptor for a charge-transporting layer is prepared.

For the charge-transporting substance, known charge-transporting substances, for example, hydrazone-based compounds such as 4-dibenzylamino-2-methylbenzaldehyde-1, 1-diphenylhydrazone can be used. For the binding resin, it is possible to use any substance as long as the substance is compatible with the charge-transporting substance, and, for example, polycarbonate, copolycarbonate, polyarylate, polyvinyl butyral, polyamide, polyester, an epoxy resin, polyurethane, polyketone, polyvinylketone, polystyrene, polyacrylamide, a phenolic resin, a phenoxy resin, a polystyrene resin, and copolymer resins of these can be used. These resins can be used alone or in combination of two or more. Among these, polystyrene, polycarbonate, copolycarbonate, polyarylate, and a polystyrene resin are preferable, because these resins have a volume resistivity of $10^{13}$ Ω·cm or more, and excellent formability and potential characteristics. For the solvent, known substances, for example, alcohols such as methanol and ethanol, ketones such as acetone, ethyl methyl ketone and cyclo, ethers such as ethyl ether, tetrahydrofuran, dioxane and dioxolane, aliphatic halogenated hydrocarbons such as chloroform, dichloromethane and dichloroethane, and aromatic substances such as benzene, chlorobenzene and toluene can be used. It should be noted that the coating composition for an electrophotographic photoreceptor for a charge-transporting layer is required to have a high volatility, because a charge-transporting layer is thick and recoating is necessary a plurality of times. Therefore, a solvent having a low boiling point is particularly preferable. Furthermore, similar additives to those in the coating composition for an electrophotographic photoreceptor for a charge-generating layer may be contained.

Next, following step s2 of forming the charge-generating layer, at step s3 of forming the charge-transporting layer, the coating composition for an electrophotographic photoreceptor that has been prepared is applied onto the bare tube for a photoreceptor on which the charge-generating layer is formed using dip coating, and thus a charge-transporting layer is formed. Thus, an electrophotographic photoreceptor is produced.

It is preferable that the charge-transporting layer and the undercoat layer are coated by the dip coating method.

The charge-transporting layer is generally as thick as 20 μm or more. When ink-jet coating is used, it is necessary to prepare a coating solution having a small solid content and a low viscosity in order to ensure a sufficient ejection performance, so that recoating is repeated a large number of times, and therefore the application takes a very long time. Furthermore, since the coating solution having a low solid content is used for recoating, it is necessary to use a solvent having a high volatility to ensure a sufficient dry property. However, use of the solvent having a high volatility may cause clogging of the nozzles due to dryness or solidification in the vicinity of the ejection nozzles, and poor leveling after attachment to the conductive substrate.

The film thickness of the undercoat layer is about 1 μm, and the viscosity of the coating solution is several mPa·s, which is a relatively low viscosity. However, the coating solution containing a pigment that has a high specific gravity and a high sedimentation such as titanium oxide is used, so that sedimentation and aggregation tend to occur at a nozzle portion, which results in ejection instabilities with high probability. Furthermore, a titanium oxide is so solid that the nozzles are worn away soon, and thus the durability deteriorates.

Electrophotographic Photoreceptor

As one embodiment of the invention, an electrophotographic photoreceptor will be described.

Figure 3:
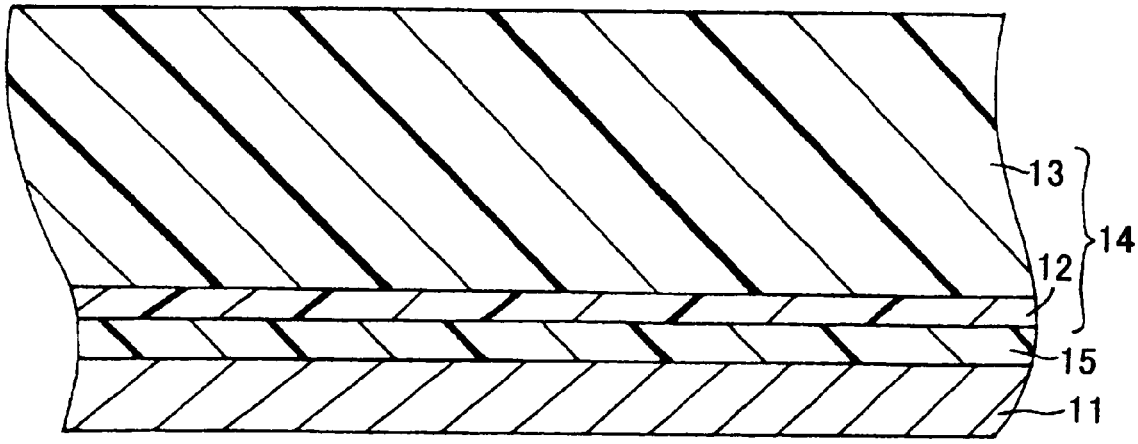
FIG. 3 is a schematic cross-sectional view showing an electrophotographic photoreceptor, which is one embodiment of the invention.

FIG. 3 is a schematic cross-sectional view showing an electrophotographic photoreceptor, which is an embodiment of the invention. The electrophotographic photoreceptor is produced by using the above-described method for producing an electrophotographic photoreceptor, and has a structure in which an undercoat layer 15 is provided on a conductive substrate 11 and a photosensitive layer 14 is further provided thereon. Furthermore, the photosensitive layer 14 is formed by laminating a charge-generating layer 12 mainly containing a charge-generating substance and a charge-transporting layer 13 mainly containing a charge-transporting substance, and thus this electrophotographic photoreceptor can be referred to as a photoreceptor of the function-separated and layered type. When a surface of the photoreceptor provided with this photosensitive layer 14 is charged negatively by using, for example, a charger, and is irradiated with light having a wavelength to be absorbed by the charge-generating layer 12, charges of electrons and holes are generated in the charge-generating layer 12. The holes are transported to the surface of the photoreceptor by the charge-transporting substance contained in the charge-transporting layer 13, and neutralize the negative charges on the surface. The electrons in the charge-generating layer 12 move toward the conductive substrate 11 on which positive charges are induced, and neutralize the positive charges thereon. Thereby, the photoreceptor of the function-separated and layered type functions.

The undercoat layer 15 is formed at the above-described step of forming an undercoat layer, and serves as a layer for binding the conductive substrate 11 with the photosensitive layer 14, and as a barrier layer for preventing charges from flowing in from the conductive substrate 11 into the photosensitive layer 14. The undercoat layer 15 maintains charging characteristics of the photoreceptor in this manner, so that the photoreceptor can be used for a long period of time. The film thickness is preferably in a range of 0.1 μm to 10 μm in order to exert the function thereof.

The charge-generating layer 12 is formed at the above-described step of forming a charge-generating layer, and serves as a layer for generating charges with visible light. The film thickness is preferably in a range of 0.05 μm to 5 μm, more preferably of 0.1 μm to 1 μm in order to exert the function thereof.

The charge-transporting layer 13 is formed at the above-described step of forming a charge-transporting layer, and serves as a layer for transporting charges generated in the charge-generating layer 12 to the surface of the photoreceptor. The ratio of the charge-transporting substances in the charge-transporting layer is preferably in a range of 30 wt % to 80 wt % in order to exert the function thereof. The film thickness is preferably in a range of 10 μm to 50 μm, more preferably in a range of 15 μm to 40 μm.

Image-Forming Apparatus

As one embodiment of the invention, an image-forming apparatus will be described.

The image-forming apparatus is obtained by applying the above-described electrophotographic photoreceptor to a conventional image-forming apparatus. Examples of the conventional image-forming apparatus include a full color copier using tandem image-forming method (manufactured by Sharp K.K.: AR-C260).

EXAMPLES

Hereinafter, the invention will be described more specifically by way of examples and comparative examples, but the invention is not limited to these examples as long as the invention does not deviate from the gist.

Example 1

Coating Composition for Electrophotographic Photoreceptor for Undercoat Layer

First, 4 parts by weight of titanium oxide ($TiO_2$: surface-coated needle rutile type) and 6 parts by weight of copolyamide resin (manufactured by Toray Industries, Inc.: CM8000) as a binding resin were added to a mixed solvent of 35 parts by weight of methyl alcohol and 65 parts by weight of 1,2-dichloroethane, and the mixture was dispersed for 8 hours by using a paint shaker, and thus a coating composition for an electrophotographic photoreceptor for an undercoat layer was prepared.

Coating Composition for Electrophotographic Photoreceptor for Charge-Generating Layer Then, 1 part by weight of titanyl phthalocyanine pigment and 1 part by weight of polyvinyl butyral resin (manufactured by Denki Kagaku Kogyo Kabushiki Kaisha: #6000-C) were added to a mixed solvent of 83 parts by weight of tetrahydrofuran (boiling point: 66° C.) and 15 parts by weight of cyclohexanone (boiling point: 155° C.), and the mixture was dispersed for 12 hours by using a paint shaker, and thus a coating composition for an electrophotographic photoreceptor for a charge-generating layer was prepared.

Coating Composition for Electrophotographic Photoreceptor for Charge-Transporting Layer Then, 9 parts by weight of 4-dibenzylamino-2-methylbenzaldehyde-1,1-diphenylhydrazone as a hydrazone-based charge-transporting substance, 14 parts by weight of bisphenol Z-type polycarbonate resin (manufactured by Mitsubishi Gas Chemical Company, Inc.: Z-400), and 0.02 part by weight of silicone-based leveling agent (manufactured by Shin-Etsu Chemical Co., Ltd.: KF-96) were added to 76 parts by weight of tetrahydrofuran and were mixed therewith, and thus a coating composition for an electrophotographic photoreceptor for a charge-transporting layer was prepared.

Step of Forming an Undercoat Layer

For a bare tube for a photoreceptor serving as a conductive substrate, an uncut cylindrical sleeve made of aluminum that has a diameter of 30 mm and a length of 360 mm and is formed by using ED method was used. The coating composition for an electrophotographic photoreceptor for a undercoat layer was applied onto the bare tube for a photoreceptor by the dip coating method and was air-dried, and thus a undercoat layer having a thickness of about 1.0 μm was formed.

Step of Forming a Charge-Generating Layer

The coating composition for an electrophotographic photoreceptor for a charge-generating layer was ejected from the ejection nozzles of a modified apparatus of an ink-jet printer (manufactured by Sharp Corporation: AR-2000) with a drop volume of 30 pl per dot, and was applied onto the undercoat layer on the bare tube for a photoreceptor rotating at a speed of 60 rpm, and was air-dried, and thus a charge-generating layer having a thickness of about 0.2 μm was formed on the undercoat layer.

Step of Forming a Charge-Transporting Layer

The coating composition for an electrophotographic photoreceptor for a charge-transporting layer was applied by the dip coating method onto the bare tube for a photoreceptor provided with the charge-generating layer that has been formed in the above-described manner, and was dried at 140° C. for 1 hour, and thus a charge-transporting layer having a thickness of about 25 μm was formed, and a photoreceptor of the function-separated and layered type was produced.

Example 2

This example is the same as Example 1 except that pyrrolidone (boiling point: 245° C.) was used instead of cyclohexanone for the coating composition for an electrophotographic photoreceptor for a charge-generating layer.

Example 3

This example is the same as Example 1 except that n-methylpyrrolidone (boiling point: 200° C.) was used instead of cyclohexanone for the coating composition for an electrophotographic photoreceptor for a charge-generating layer.

Example 4

This example is the same as Example 1 except that p-xylene (boiling point: 138.4° C.) was used instead of cyclohexanone for the coating composition for an electrophotographic photoreceptor for a charge-generating layer.

Example 5

This example is the same as Example 1 except that 63 parts by weight of tetrahydrofuran and 35 parts by weight of cyclohexanone were used instead of 83 parts by weight of tetrahydrofuran and 15 parts by weight of cyclohexanone for the coating composition for an electrophotographic photoreceptor for a charge-generating layer.

Example 6

This example is the same as Example 1 except that 58 parts by weight of tetrahydrofuran, 20 parts by weight of cyclohexanone, and 20 parts by weight of pyrrolidone were used instead of 83 parts by weight of tetrahydrofuran and 15 parts by weight of cyclohexanone for the coating composition for an electrophotographic photoreceptor for a charge-generating layer.

COMPARATIVE EXAMPLE 1

This example is the same as Example 1 except that 98 parts by weight of tetrahydrofuran was used instead of 83 parts by weight of tetrahydrofuran and 15 parts by weight of cyclohexanone for the coating composition for an electrophotographic photoreceptor for a charge-generating layer.

COMPARATIVE EXAMPLE 2

This example is the same as Example 1 except that 45 parts by weight of cyclohexanone and 53 parts by weight of tetrahydrofuran were used instead of 83 parts by weight of tetrahydrofuran and 15 parts by weight of cyclohexanone for the coating composition for an electrophotographic photoreceptor for a charge-generating layer.

COMPARATIVE EXAMPLE 3

This example is the same as Example 1 except that 2.5 parts by weight of titanyl phthalocyanine pigment, 2.5 parts by weight of polyvinyl butyral resin, and 80 parts by weight of tetrahydrofuran were used instead of 1 part by weight of titanyl phthalocyanine pigment, 1 part by weight of polyvinyl butyral resin, and 83 parts by weight of tetrahydrofuran for the coating composition for an electrophotographic photoreceptor for a charge-generating layer.

COMPARATIVE EXAMPLE 4

This example is the same as Example 1 except that tripropylene glycol (boiling point: 271° C.) was used instead of cyclohexanone for the coating composition for an electrophotographic photoreceptor for a charge-generating layer.

COMPARATIVE EXAMPLE 5

This example is the same as Example 1 except that 95 parts by weight of tetrahydrofuran and 3 parts by weight of cyclohexanone were used instead of 83 parts by weight of tetrahydrofuran and 15 parts by weight of cyclohexanone for the coating composition for an electrophotographic photoreceptor for a charge-generating layer.

COMPARATIVE EXAMPLE 6

This example is the same as Example 1 except that in the step of forming an undercoat layer, the coating composition for an electrophotographic photoreceptor for an undercoat layer was ejected from the ejection nozzles of a modified apparatus of an ink-jet printer with a drop volume of 30 pl per dot and was applied onto the undercoat layer on the bare tube for a photoreceptor rotating at a speed of 60 rpm, instead of applying the coating composition for an electrophotographic photoreceptor for an undercoat layer by the dip coating method.

COMPARATIVE EXAMPLE 7

This example is the same as Example 1 except that in the step of forming a charge-transporting layer, the coating composition for an electrophotographic photoreceptor for a charge-transporting layer was ejected from the ejection nozzles of a modified apparatus of an ink-jet printer with a drop volume of 30 pl per dot and was applied onto the undercoat layer on the bare tube for a photoreceptor rotating at a speed of 60 rpm, instead of applying the coating composition for an electrophotographic photoreceptor for a charge-transporting layer by the dip coating method.

Evaluation

Examples 1 to 6 and Comparative Examples 1 to 7 were evaluated in terms of ejection performance, storage stability, appearance, image-reproduction performance, and image defects as follows. Each electrophotographic photoreceptor produced by the above-described methods was evaluated by the following evaluation methods. Tables 1 to 3 show the results.

Letters "A", "B", and "C" used in explanations of the evaluation items show the evaluation results used in Tables 1 to 3. "A" means being extremely excellent, "B" means being practicable, and "C" means being difficult to put in practical use.

Evaluations of image-reproduction performance and image defects were performed by performing printing at room temperature and room humidity (25° C., 50%), using an apparatus in which each electrophotographic photoreceptor produced by the above-described methods was attached to a full color copier using tandem image-forming method (manufactured by Sharp K. K.: AR-C260).

Evaluation of Ejection Performance

A charge-generating layer was formed in the step of forming a charge-generating layer, and the ejection performance was evaluated based on the following criteria.

A: Clogging does not occur in the ejection nozzles.

C: Clogging occurs in the ejection nozzles.

Evaluation of Storage Stability

Each coating composition for an electrophotographic photoreceptor was put into a sample bottle and stored at 25° C. for 1 week, and the storage stability was evaluated based on the following criteria.

A: Sedimentation or aggregation does not occur.

B: Sedimentation occurs, but the sediment can be easily dispersed again, and thus no aggregate is generated.

C: Sedimentation and aggregation occur.

Evaluation of Appearance

The storage stability of the formed charge-generating layers was evaluated based on the following criteria.

A: The surface is uniform.

C: The surface is non-uniform.

Evaluation of Image-Reproduction Performance

A test chart was printed on a recording medium by using the above-described methods, and was evaluated based on the following criteria.

A: The image is clear without ink-spread or blur etc.

C: Ink-spread or blur etc. is caused.

Evaluation of Image Defects

A test chart was printed on a recording medium, and was evaluated based on the following criteria.

A: No defect such as fogs or black dots occurs in the image.

C: Defects such as fogs or black dots occur in the image.

Examples 1 to 6 and Comparative Examples 1 to 7 were evaluated in comparison with one another based on the above-described methods. Tables 1 to 3 show the results.

TABLE 1

| | charge-generating layer | | | | image characteristics | | |
|---|---|---|---|---|---|---|---|
| | ejection performance | Storage stability | Appearance | viscosity (mPa · s) | image-reproduction performance | image defects | total evaluation |
| Ex. 1 | A | A | A | 3.2 | A | A | A |
| Ex. 2 | A | A | A | 2.5 | A | A | A |
| Ex. 3 | A | A | A | 2.8 | A | A | A |
| Ex. 4 | A | B | A | 4.1 | A | A | A |
| Ex. 5 | A | A | A | 3.5 | A | A | A |
| Ex. 6 | A | A | A | 3.0 | A | A | A |
| Com. Ex. 1 | C | B | C | 2.1 | — | | C |
| Com. Ex. 2 | A | A | C | 3.7 | C | C | C |
| Com. Ex. 3 | C | C | C | 11.2 | — | | C |
| Com. Ex. 4 | A | A | C | 3.9 | — | | C |
| Com. Ex. 5 | A | B | C | 2.5 | C | C | C |

TABLE 2

| | charge-generating layer | | | | image characteristics | |
|---|---|---|---|---|---|---|
| | ejection performance | storage stability | Appearance | viscosity (mPa · s) | image-reproduction performance | total evaluation |
| Com. Ex. 6 | C | B | C | 5.5 | — | C |

TABLE 3

| | charge-generating layer | | | | image characteristics | |
|---|---|---|---|---|---|---|
| | ejection performance | storage stability | Appearance | viscosity (mPa · s) | image-reproduction performance | total evaluation |
| Com. Ex. 7 | C | A | C | 2.5 | — | C |

Table 1 shows that Examples 1 to 6, which are the embodiments of the invention, were the coating compositions for an electrophotographic photoreceptor having excellent ejection performance and storage stability. When these coating compositions for an electrophotographic photoreceptor were used, an electrophotographic photoreceptor including a charge-generating layer having excellent appearance was produced. Furthermore, when this electrophotographic photoreceptor was used, images having excellent image-reproduction performance and no image defect were printed.

With the coating composition for an electrophotographic photoreceptor containing no high-boiling point solvent (Comparative Example 1), the ejection performance was not good. The reason for this seems to be that the solvent contains only a low-boiling point solvent without a high-boiling point solvent, so that the solvent volatilizes easily and therefore clogging is caused in the ejection nozzles. In the case where an electrophotographic photoreceptor was produced by using this coating composition for an electrophotographic photoreceptor, defective application occurred when a charge-generating layer was formed, and thus a desired charge-generating layer was not formed. Accordingly, it was apparent that a desired electrophotographic photoreceptor was not produced, and thus it was judged that there was no need to evaluate the image.

With the coating composition for an electrophotographic photoreceptor containing a high-boiling point solvent at the ratio of more than 40 parts by weight (Comparative Example 2), the ejection performance and the storage stability were excellent. However, when an electrophotographic photoreceptor was produced by using this coating composition for an electrophotographic photoreceptor, a charge-generating layer having a non-uniform surface was obtained. The reason for this seems to be that the content of a high-boiling point solvent is high, and thus the solvent is difficult to volatilize, so that the applied coating composition for an electrophotographic photoreceptor is difficult to dry and tends to drop. When an image was formed by using this electrophotographic photoreceptor, the image-reproduction performance was poor and image defects occurred in the image.

With the coating composition for an electrophotographic photoreceptor having a viscosity of higher than 10 mPa·s (Comparative Example 3), the viscosity was so high that the ejection performance and the storage stability were not good. When an electrophotographic photoreceptor was produced by using this coating composition for an electrophotographic photoreceptor, defective application occurred while forming a charge-generating layer, and thus a desired charge-generating layer was not formed. Accordingly, it was apparent that a desired electrophotographic photoreceptor was not produced, and thus it was judged that there was no need to evaluate the image as in Comparative Example 1.

With the coating composition for an electrophotographic photoreceptor containing a solvent having a boiling point of higher than 260° C. as a high-boiling point solvent (Comparative Example 4), the charge-generating layer was not sufficiently air-dried, and when a charge-transporting layer was formed, a part of the surface of the charge-generating layer was melted and defective application such as a liquid drop occurred. Accordingly, it was apparent that a desired electrophotographic photoreceptor was not produced, and thus it was judged that there was no need to evaluate the image.

With the coating composition for an electrophotographic photoreceptor containing a high-boiling point solvent at the ratio of less than 5 parts by weight (Comparative Example 5), the ejection performance was improved, because 3 parts by weight of cyclohexanone, which was a high-boiling point solvent, was added. However, when an electrophotographic photoreceptor was produced by using this coating composition for an electrophotographic photoreceptor, a charge-generating layer having a non-uniform surface was obtained. The reason for this seems to be that the content of a high-boiling point solvent is low, and thus the applied coating composition for an electrophotographic photoreceptor is dried too easily. When an image was formed by using this electrophotographic photoreceptor, the image-reproduction performance was poor and image defects occurred in the image.

Table 2 shows that when the coating composition for an electrophotographic photoreceptor for an undercoat layer was ejected and applied by ink-jet coating (Comparative Example 6), defective application occurred, because the coating composition for an electrophotographic photoreceptor for an undercoat layer did not have sufficient ejection performance, and thus a desired undercoat layer was not formed. The reason for this seems to be that the coating composition for an electrophotographic photoreceptor for an undercoat layer contains a titanium oxide having a high solidity, so that the application method using ink-jet coating damages ejection nozzles, and thus ejection performance becomes poor. Accordingly, it was apparent that a desired electrophotographic photoreceptor was not produced, and thus it was judged that there was no need to evaluate the image as in Comparative Example 1.

Table 3 shows that when the coating composition for an electrophotographic photoreceptor for a charge-transporting layer was ejected and applied by ink-jet coating (Comparative Example 7), defective application occurred, because the coating composition for an electrophotographic photoreceptor for a charge-transporting layer did not have sufficient ejection performance, and thus a desired charge-transporting layer was not formed. The reason for this seems to be as follows. The charge-transporting layer should be thick, and therefore it is necessary to recoat the coating composition for an electrophotographic photoreceptor for a charge-transporting layer a plurality of times. For this reason, the coating composition for an electrophotographic photoreceptor for a charge-transporting layer has a high volatility, but the coating composition clogs ejection nozzles during ejection due to the high volatility, so that ejection performance becomes poor. Accordingly, it was apparent that a desired electrophotographic photoreceptor was not produced, and thus it was judged that there was no need to evaluate the image.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A coating composition for an electrophotographic photoreceptor that forms a charge-generating layer by being ejected from ejection nozzles in a form of droplets, the coating composition comprising:

a charge-generating substance, a binding resin, and a solvent, a viscosity of the coating composition being in a range of 1 mPa·s to 10 mPa·s, wherein the solvent contains two high-boiling point solvents having a boiling point of 150° C. to 260° C. and a low-boiling point solvent having a boiling point of at least 30° C. and less than 120° C., a difference in a boiling point between the two high-boiling point solvents is in a range of 70° C. to 110° C., a difference in a boiling point between the low-boiling point solvent and the two high-boiling point solvents is 70° C. or more, and wherein the two high-boiling point solvents are contained at a ratio of 5 parts by weight to 40 parts by weight with respect to 100 parts by weight of the coating composition for an electrophotographic photoreceptor.

2. The coating composition of claim 1, wherein a difference between the boiling points of the two high-boiling solvents is in a range of 80° C. to 110° C.

3. The coating composition of claim 1, wherein the two high-boiling point solvents are cyclohexanone and pyrrolidone.

4. The coating composition of claim 1, wherein a content of the low-boiling point solvent is at least 1.4 times and at most 10 times a content of the high-boiling point solvent.

5. The coating composition of claim 1, wherein the charge-generating substance is a phthalocyanine compound.

6. An electrophotographic photoreceptor comprising the composition of claim 1.

7. An image-forming apparatus using the electrophotographic photoreceptor of claim 6.

* * * * *